United States Patent [19]

Johnson

[11] 3,998,424

[45] Dec. 21, 1976

[54] TIE ROD WITH EXPANDABLE LOCKING CONE

[76] Inventor: Calvin R. Johnson, 2711 Winston Ave., Las Cruces, N. Mex. 88001

[22] Filed: Aug. 6, 1975

[21] Appl. No.: 602,305

[52] U.S. Cl. ..... 249/190; 249/40; 249/217

[51] Int. Cl.[2] ..... E04G 17/08

[58] Field of Search ..... 249/40–46, 249/190–191, 213–214, 216–217, 219 W

[56] References Cited

UNITED STATES PATENTS

| | | | |
|---|---|---|---|
| 3,018,538 | 1/1962 | Gates | 249/219 W |
| 3,482,813 | 12/1969 | Wells et al. | 249/46 |
| 3,638,904 | 2/1972 | Franklin et al. | 249/40 |
| 3,907,244 | 9/1975 | Abbott | 249/46 |
| 3,918,673 | 11/1975 | Abbott | 249/216 |
| 3,926,400 | 12/1975 | Franc | 249/40 |

FOREIGN PATENTS OR APPLICATIONS

| | | | |
|---|---|---|---|
| 2,005,210 | 9/1971 | Germany | 249/42 |

*Primary Examiner*—Richard B. Lazarus
*Assistant Examiner*—John McQuade
*Attorney, Agent, or Firm*—Clarence A. O'Brien; Harvey B. Jacobson

[57] ABSTRACT

A tie structure is provided for use in conjunction with concrete forms and includes structure whereby the form sections are prevented from collapsing inward until concrete is poured in the form. A first form of tie includes an expandable locking cone which may be expanded in diameter on the inner side of the form after the tie is placed in position in the form and as the locking lever of an associated waler bracket is moved to the applied position. A second form of tie construction utilizes an axially compressible and radially expandable sleeve for expansion in the tie opening formed in the concrete form.

7 Claims, 5 Drawing Figures

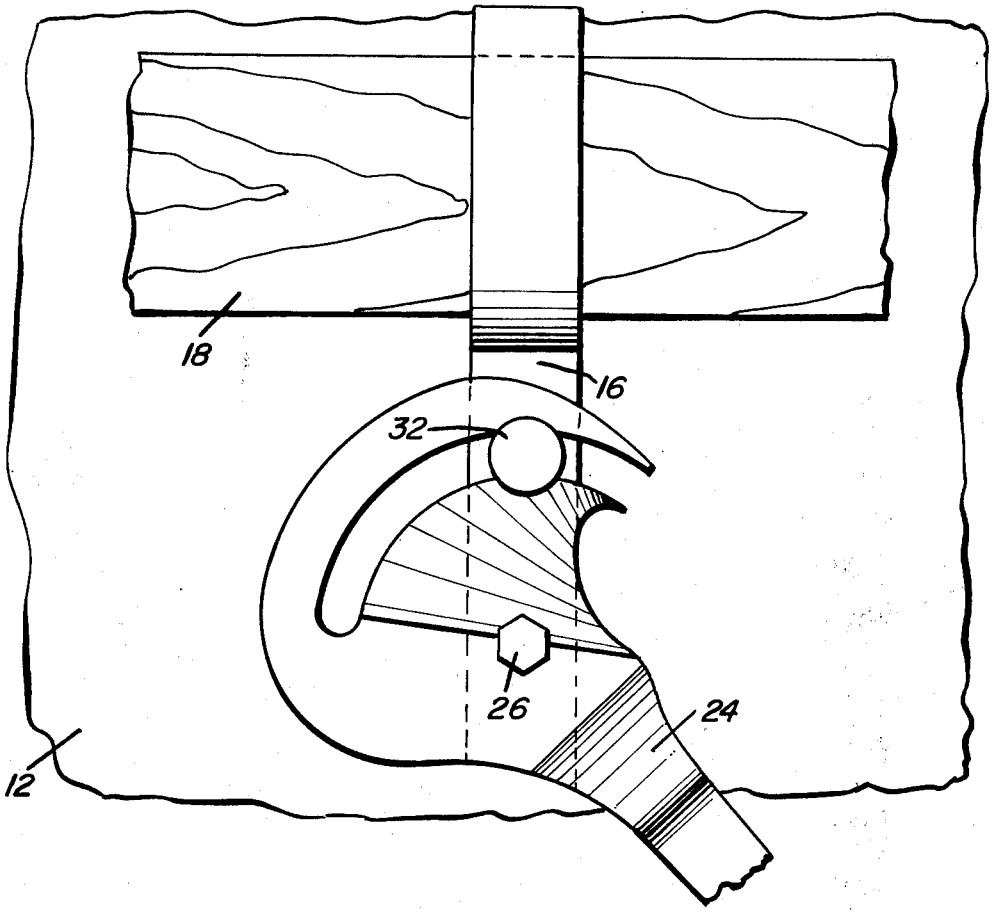
Fig. 1
Fig. 4
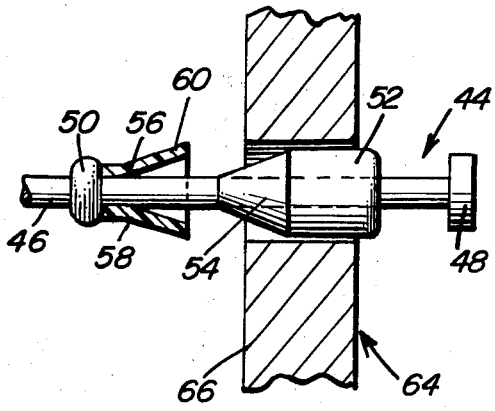
Fig. 5
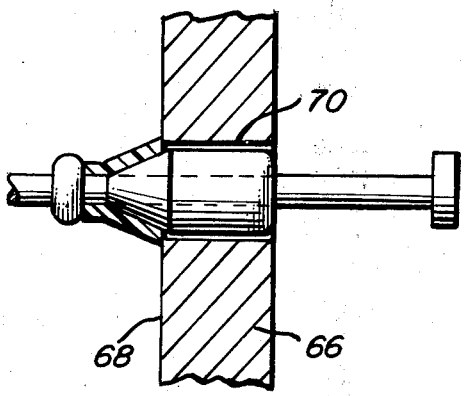

TIE ROD WITH EXPANDABLE LOCKING CONE

BACKGROUND OF THE INVENTION

Various forms of ties for use in constructing concrete walls have been heretofore designed. The main function of a tie is to prevent opposite sections of the form paneling from spreading as concrete is poured into the form. However, when erecting a form for pouring a concrete wall difficulty is sometimes encountered in the form of a tendency of the form panels collapsing inward before the concrete is poured into the form.

Examples of previously designed concrete form ties are disclosed in U.S. Pat. Nos. 3,430,913, 3,464,667, 3,465,999, 3,529,800, 3,693,931, 3,801,061 and 3,822,860.

BRIEF DESCRIPTION OF THE INVENTION

The tie structure of the instant invention is constructed in a manner, in addition to its basic function of preventing spreading of the walls of a form away from each other as concrete is poured into the form, to provide an apparatus whereby the walls of a form will be prevented from collapsing inward before concrete is poured into the form.

The tie structure of the instant invention may be utilized for either gang forming or piecemeal forming and therefore eliminates the confusion and expense of having to inventory two different types of ties on a large job requiring both gang forming ties and piecemeal forming ties.

The main object of this invention is to provide a tie structure which will be capable of not only preventing spreading of the walls of a form as concrete is poured into the form but which will also function to prevent inward collapsing of the walls of the form prior to concrete being poured into the form.

Another object of this invention in accordance with the immediately preceding object is to provide a tie structure which may be utilized to advantage both in gang forming or piecemeal forming operations.

Still another object of this invention is provide a tie construction which may be utilized in conjunction with conventional waler brackets.

A final object of this invention is to provide a tie structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an elevational view of a waler bracket utilized in conjunction with a first form of tie construction;

FIG. 4 is a vertical sectional view through a form wall having a second form of tie construction operatively associated therewith and with the expandable portion of the second form of tie construction illustrated in an unexpanded position; and FIG. 5 is a view similar to FIG. 4 illustrating the expandable portion of the second form of tie construction in an expanded position.

DETAILED DESCRIPTION OF THE INVENTION

Figure 2:
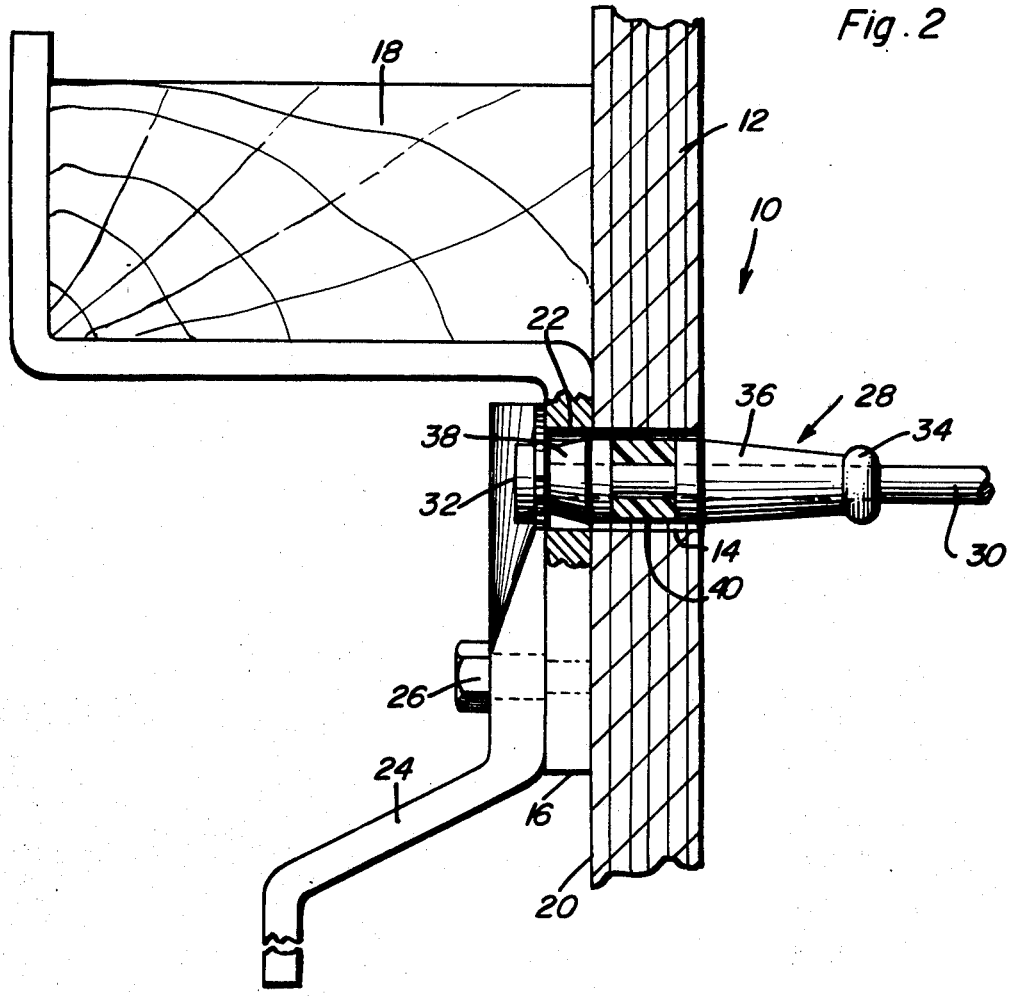
FIG. 2 is a side elevational view of the assemblage illustrated in FIG. 1 and with a portion of the form wall, tie construction and waler bracket illustrated in vertical section.
Figure 3:
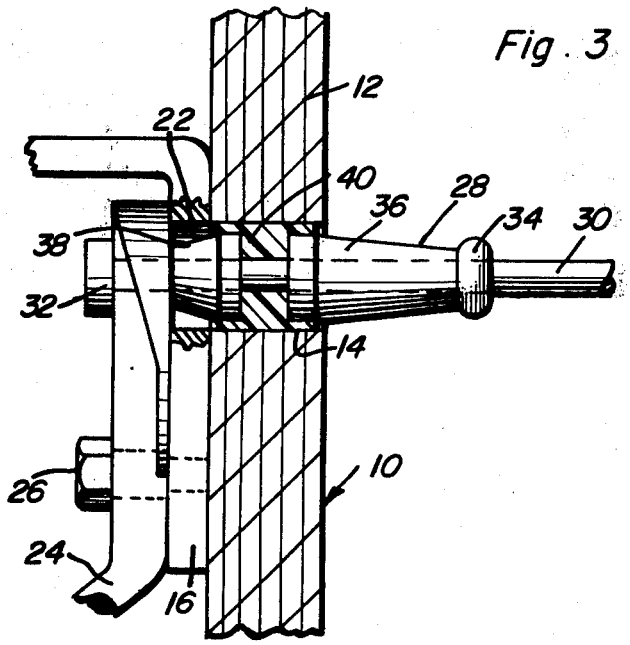
FIG. 3 is a view similar to FIG. 2 but with the expandable sleeve of the tie construction in a fully expanded position.

Referring now more specifically to FIGS. 1, 2 and 3 of the drawings the numeral 10 generally designates a concrete form including a first wall 12 having a tie opening 14 formed therethrough. A waler bracket 16 supporting a conventional horizontal 2×4 18 is supported on the exterior surface 20 of the wall 12 with the opening 22 formed in the bracket 16 registered with the opening 14. Of course, the bracket 16 includes the usual cam lever 24 pivotally secured thereto as at 26.

A first form of tie assembly constructed in accordance with the present invention is referred to in general by the reference numeral 28 and includes a tie rod 30 of substantially conventional design including an enlarged head 32 on one end. The end portion of the rod 30 upon which the head 32 is supported also includes an enlarged abutment 34 spaced axially along the rod 30 from the head 32 and a substantially rigid sleeve 36 is slidably disposed on the rod 30 between the abutment 34 and the head 32. In addition, a substantially rigid plunger 38 is slidably disposed on the rod 30 immediately adjacent the head 32 and an axially compressible and radially expandable sleeve 40 is slidably mounted on the rod 30 intermediate the sleeve 36 and the plunger 38.

The head 32, plunger 38, sleeve 40 and sleeve 36 are projectable through the opening 14 and the cam lever 34 may be engaged with and beneath the head 32 in the conventional manner and rotated to an actuated position in order to draw the rod 30 to the left as viewed in FIG. 2 of the drawings, the lever 24 being abutted by the plunger 38 to prevent its movement to the left, but the abutment 34 bearing against the sleeve 36 causing the latter to move with the rod 30 toward the plunger 38 so as to axially compress and radially expand the sleeve 40 from the state illustrated in FIG. 2 to the state illustrated in FIG. 3 in which the sleeve 40 is tightly expanded in the opening 14, thus locking the wall 12 against movement in either direction relative to the tie rod 30. The sleeve 36 and plunger 38 may be constructed of any hard material such as hard plastic and the axially compressible and radially expandable sleeve 40 may be formed of any suitable material such as soft plastic capable of being expandable into the position illustrated in FIG. 3. Of course, the sleeve 40 may also be constructed of soft lead and other reasonably soft and deformable materials.

Referring now more specifically to FIGS. 4 and 5 of the drawings, there may be seen a modified form of tie construction referred to in general by the reference numeral 44. The tie construction 44 includes the usual tie rod 46 having a head 48 corresponding to the head 32 and a diametrically enlarged abutment 50 corresponding to the abutment 34. In addition, the tie construction 44 includes a relatively hard wedge sleeve 52 similar to the sleeve 36 but which includes a conical end 54 facing toward the abutment 50.

The tie construction 44 further includes an abutment sleeve of relatively hard, but expandable material referred to by the reference numeral 56. The sleeve 56 includes a cylindrical end portion 58 and a hollow substantially constant wall thickness conical end portion 60. The cylindrical end portion 58 is snugly slidably received on the rod 46 immediately adjacent the abutment 50 and the conical end portion 60 defines a conical socket centrally through which the rod 46 extends and which opens toward the conical end 54 of the sleeve or plunger 52.

The concrete form with which the tie construction 44 may be used is referred to in general by the reference numeral 64 and includes a wall 66 corresponding to the wall 12. Actuation of the tie construction 44 is substantially identical to the actuation of the tie construction 28 in that the lever portion of a waler bracket corresponding to the waler bracket 16 is engaged behind the head 48 with the piston 52 abutted against the lever and the rod 46 axially shifted to the right as viewed in FIG. 4 of the drawings whereby the abutment 50 will cause the conical end 60 of the sleeve 56 to be advanced toward and expanded by the conical end 54 of the piston 52. From FIG. 5 of the drawings, it may be seen that the expanded conical end 60 of the sleeve 56 abuts against the inner surface portions 68 of the wall 66 disposed immediately about the opening 70 in the wall through which the tie construction 44 extends when the sleeve 56 has its conical end 60 expanded. Thus, the wall 66 is prevented from collapsing inwardly.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a concrete form wall including inner and outer sides, a tie rod, said wall having a tie rod opening formed therethrough, one end portion of said tie rod projecting centrally through said opening and having an enlarged head thereon spaced outwardly of the outer side of said wall, a wedge sleeve slidably mounted on said rod and receiving in and projecting outwardly of the inner end of said opening, an expandable abutment sleeve slidable on said rod inwardly of said wedge sleeve and a fixed enlargement on said rod inwardly of said abutment sleeve against which the opposing end of said abutment sleeve may be abutted, said abutment sleeve being of a size, before being expanded, to be snugly received through said opening, said enlargement and abutment sleeve being disposed inwardly of said inner side of said wall, said wedge sleeve including wedge portions on the end thereof adjacent said abutment sleeve wedgingly receivable into the adjacent end of said abutment sleeve for expansion of the last-mentioned end from within to a cross-sectional size larger than the cross-sectional size of the end of said opening opening through the inner side of said wall, and means operatively connected between said wall, head and wedge sleeve for drawing said one end portion of said rod outwardly through said opening relative to said wedge sleeve, and thus also drawing said enlargement toward said wedge sleeve, whereby to engage said abutment sleeve between said wedge sleeve and enlargement and effect wedging engagement of said wedge portions of said wedge sleeve into the adjacent abutment sleeve end and expansion of said adjacent abutment sleeve end to said larger cross-sectional size and thereafter substantially fully and tightly end abut the end surfaces of the expanded end of said abutment sleeve with the surface portions of the inner side of said wall extending fully about said opening to prevent inward shifting of said wall relative to said abutment sleeve and thus said rod.

2. The combination of claim 1 wherein said wedge and abutment sleeves include male and female conical end portions, respectively, opposing each other, said male end portion being wedgingly receivable in said female end portion for expanding the latter.

3. The combination of claim 2 wherein the major diameter end of said expanded female end portion has its axial end disposed concentric with said opening.

4. The combination of claim 3 wherein said female end portion of said abutment sleeve includes substantially constant thickness wall portions.

5. The combination of claim 3 wherein the end portion of said abutment sleeve remote from said female end portion comprises a cylindrical end portion.

6. In combination, a concrete form wall including inner and outer sides, a tie rod, said wall having a tie rod opening formed therethrough, one end portion of said tie rod projecting centrally through said opening, an expandable abutment sleeve concentric with and mounted on said rod in a position spaced from the inner side of said wall and prevented from movement longitudinally of said rod in a direction away from said inner side of said wall by a fixed enlargement on said rod, said sleeve being of a size, before being expanded, to be snugly received through said opening, and means connected between said rod and wall and engageable with said sleeve to effect longitudinal movement of said one end portion further outwardly through said opening and thus movement of said sleeve toward the inner side of said wall and to effect expansion of the end of said sleeve opposing the inner side of said wall to a cross-sectional size larger than the cross-sectional size of the end of said opening opening outwardly through the inner side of said wall during said movement, whereby to substantially fully and tightly end abut said sleeve end with the surface portions of the inner side of said wall extending about said opening to prevent inward shifting of said wall relative to said rod.

7. The combination of claim 6 wherein said means connected between said rod and wall and engageable with said sleeve also includes means operative to prevent outward movement of said wall relative to said rod.

* * * * *